US009612050B2

(12) United States Patent
Palmer

(10) Patent No.: US 9,612,050 B2
(45) Date of Patent: Apr. 4, 2017

(54) SIMPLIFIED LNG PROCESS

(75) Inventor: Gary Palmer, Calgary (CA)

(73) Assignee: 9052151 Canada Corporation, Toronto, ON (CA)

( * ) Notice: Subject to any disclaimer, the term of this patent is extended or adjusted under 35 U.S.C. 154(b) by 0 days.

(21) Appl. No.: 13/349,219

(22) Filed: Jan. 12, 2012

(65) Prior Publication Data

US 2013/0180282 A1 Jul. 18, 2013

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0208* (2013.01); *F25J 1/0232* (2013.01); *F25J 1/0254* (2013.01); *F25J 2205/04* (2013.01); *F25J 2220/62* (2013.01); *F25J 2220/64* (2013.01); *F25J 2220/66* (2013.01); *F25J 2230/30* (2013.01); *F25J 2240/40* (2013.01); *F25J 2245/90* (2013.01); *F25J 2270/90* (2013.01); *F25J 2290/62* (2013.01)

(58) Field of Classification Search
CPC ..... F25J 2220/66; F25J 1/0022; F25J 3/0209; F25J 3/0214; F25J 3/0223; F25J 3/0238; F25J 3/0242; F25J 3/0257; F25J 3/0266; F25J 3/061; F25J 3/0615; F25J 2220/62; F25J 2220/64; F25J 2210/60
USPC ..... 62/611, 617, 618, 620
See application file for complete search history.

(56) References Cited

U.S. PATENT DOCUMENTS 3,771,260 A * 11/1973 Arenson ..... B01F 3/022 261/118
4,025,321 A * 5/1977 Anderson et al. ..... 95/123
4,203,742 A * 5/1980 Agnihotri ..... C07C 7/00 62/621
5,141,544 A * 8/1992 Butts ..... F25J 3/0209 62/628
6,205,813 B1 * 3/2001 Shah et al. ..... 62/630
8,020,406 B2 * 9/2011 Vandor et al. ..... 62/613
2002/0088249 A1 * 7/2002 Minta ..... F25J 1/0254 62/612
2004/0177646 A1 * 9/2004 Wilkinson ..... F25J 1/0201 62/614
2007/0227186 A1 * 10/2007 Alferov ..... B01D 5/0033 62/620
2008/0134717 A1 * 6/2008 Dam et al. ..... 62/618
(Continued)

*Primary Examiner* — Frantz Jules
*Assistant Examiner* — Brian King
(74) *Attorney, Agent, or Firm* — Adrian D. Battison; Ade & Company Inc.

(57) ABSTRACT

A simplified method for production of a commercial supply liquefied natural gas (LNG) supplied in a pressurized vessel includes taking a supply of natural gas including contaminants from a stranded well or from a pipe line and extracting from the supply gas water vapor and CO2 in a fixed bed absorption system. In a first stage the supply gas is separated into first and second streams where the first stream contains all the cold energy available from the feed stream and sufficient of the contaminants are removed to meet a product specification for the composition of the LNG supply. In a second stage the first stream is liquefied by the available cool energy for commercial pressurized supply container The second stream contains natural gas which is as much as 75% of the feed stream together with substantially all the contaminants and is used as a natural gas supply.

13 Claims, 1 Drawing Sheet

(56) References Cited

U.S. PATENT DOCUMENTS

| | | | | |
|---|---|---|---|---|
| 2009/0113928 | A1* | 5/2009 | Vandor | F25J 1/0022 62/612 |
| 2009/0221864 | A1* | 9/2009 | Mak | 585/803 |
| 2009/0299122 | A1* | 12/2009 | Geers et al. | 585/857 |
| 2010/0031700 | A1* | 2/2010 | Wilkinson | F25J 1/0022 62/620 |
| 2010/0154471 | A1* | 6/2010 | Brown | F25J 3/0214 62/620 |
| 2011/0023536 | A1* | 2/2011 | Jager | F25J 1/0022 62/611 |

* cited by examiner

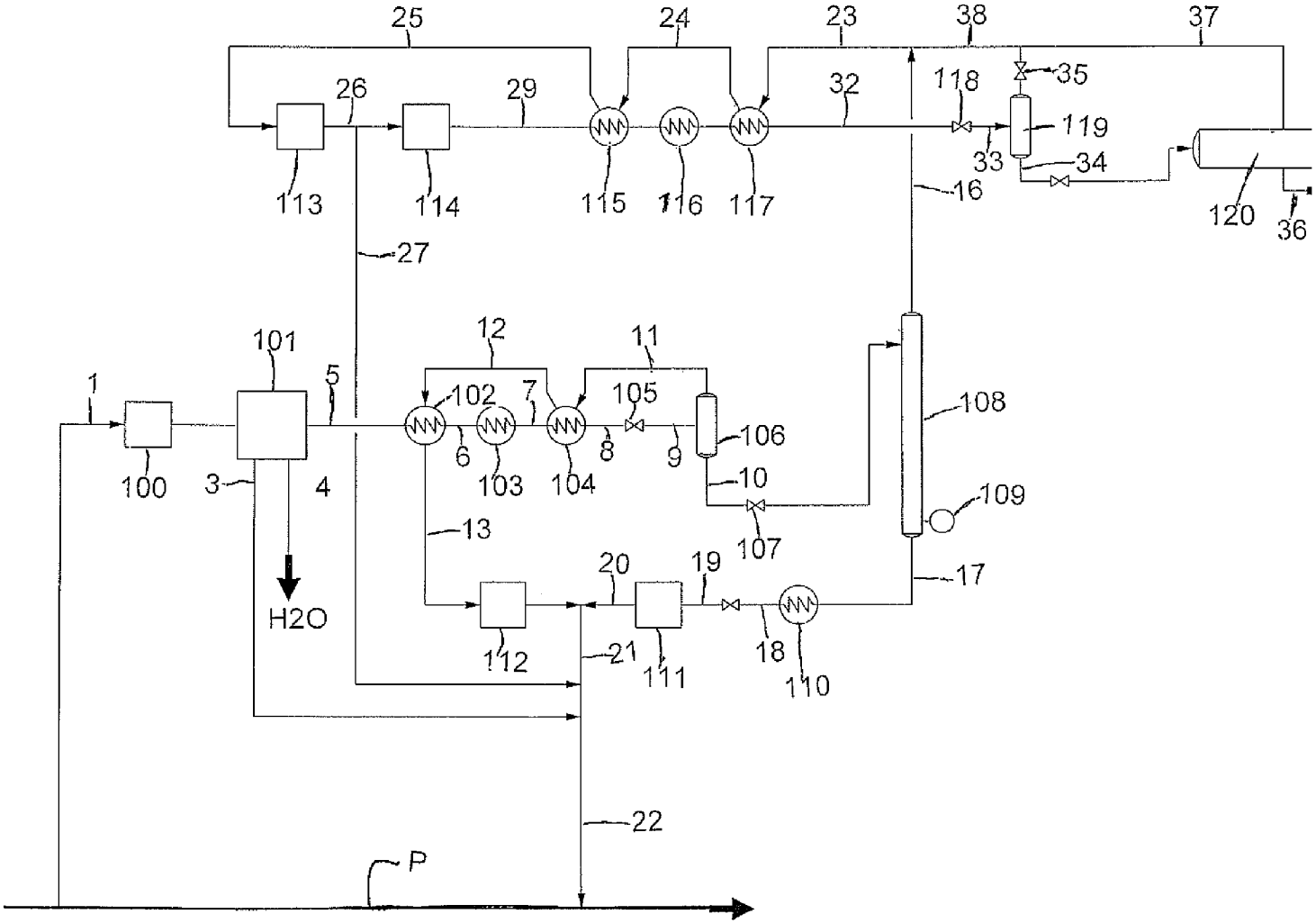
H2O
P

SIMPLIFIED LNG PROCESS

This invention relates to method for production of liquefied natural gas (LNG).

BACKGROUND OF THE INVENTION

Liquefied Natural gas, LNG, is primarily methane, propane and other heavier hydrocarbons. Producers of LNG until recently had considerable flexibility in the specifications of the gas that they liquefied, but there is now a trend toward tightening the composition requirements for LNG, specifically in North America which has seen the current standards for methane content approaching 100%. This means that in order to meet the new standards of these markets, producers of LNG are faced with not only the formidable problem of liquefying the fuel, but also using cryogenic fractionation to exclude the undesirable components such as helium, nitrogen, CO2, ethane, propane and heavier from the mixture.

The production of LNG is most applicable in situations where the source of the gas is an isolated field so far from markets for the gas that a pipeline cannot be economically justified. A gas liquefaction plant could then be located at or near the stranded gas field where the well head gas could be purified by removal of contaminants such as sulfur and CO2, then chilled and fractionated to remove light overhead gas components plus the heavier hydrocarbons, leaving a cryogenic liquid product that is almost pure methane. The LNG can be transported, usually by ship, to waiting markets where it can be vaporized, compressed and distributed to waiting markets by pipeline. The conditioning of the gas at source meets the stringent requirements of pipeline companies and by consumers of natural gas. Most liquefaction facilities have been located around the Atlantic and Pacific basins to serve markets in Europe, North America and Japan, but recently there have been new LNG facilities established in the Middle East to serve markets in Europe. Another use for LNG technology is for peak shaving to meet periods of high demand for natural gas. Many small countries far from markets for their gas have benefited economically from the strategy of exporting their surplus gas in the form of LNG.

In the conventional LNG process, raw gas entering the liquefaction plant must first be treated for removal of sulfur compounds, CO2 and Water. Specifications for natural gas specify that sulfur compounds, if any, must be totally removed except for a few PPM. Carbon dioxide must be removed so that it does not freeze and form a solid (dry ice) in the cryogenic equipment downstream. Water vapor must be removed to less than one part per million to avoid formation of gas hydrates. The conventional LNG process uses amine to remove sulfur compounds and CO2 followed by a fixed bed desiccant process to remove water.

The most practical way to transport natural gas is by pipeline, but, if a pipeline cannot be economically justified, then alternate methods must be used. The problem in transferring gas from one location to another in any type of container is the volume of the gas. Even a very small quantity of gas occupies a very large volume. This is the reason why the LNG process was developed. By liquefying the gas at −255 F (−160 C) and one atmosphere its volume can be reduced by a factor of 600. The LNG thus produced is a clear colorless liquid having a specific gravity of 0.45.

Liquefaction makes it practical to ship the gas as LNG by tanker. LNG tankers are huge double hulled ships specifically designed to contain the LNG within the inner hull of the vessel. Then cargo must be maintained at −255 F (160 C) at one atmosphere by an on board refrigeration system. The LNG tanks on board the ship are usually huge spheres, although other types of containment can be used. LNG ships are huge, typically containing up to 2,825 MMSCFD (80 000 000 $SM^3$) of natural gas transported in liquefied form as 5,000,000 cubic feet (140,000 M3) of LNG on board the ship. Because of the huge size of the LNG containment vessels it is not practical to design them as pressure vessels. They are designed to transport the liquefied gas at atmospheric pressure which means the cargo must remain chilled to −255 F. If the gas pressure could be several atmospheres the shipping temperature could be somewhat higher.

Chilling the gas to its liquefaction temperature involves mechanical refrigeration and isenthalpic and/or isentropic expansions by means of let down valves or turbo expanders. Unwanted light gases are eliminated by cryogenic fractionation as are ethane and heavier fractions. Because temperatures are so low in the conventional process special refrigerant systems are required such as the nitrogen cycle or the ethylene vapor/liquid cycle. Standard industrial refrigeration equipment normally cannot be used. Fractionation to produce an LPG product that is essentially pure methane is a major challenge and the process is complex to make it efficient. The complexity is justified by the need for energy efficiency in a large scale plant that produces LNG by the shipload. In those very large LNG plants, energy efficiency is a vital concern.

Using the conventional LNG Process is not practical for small scale. LNG plants because the cost and complexity of the process makes the cost of the LNG product too expensive.

SUMMARY OF THE INVENTION

It is one object of the invention to provide a simplified process with the result that producing LNG on a small scale can be practical.

According to one aspect of the invention there is provided a method for production of liquefied natural gas (LNG) comprising:

taking a supply of natural gas including contaminants;

extracting from the supply gas water vapor and CO2;

in a first stage, separating the supply gas into first and second streams;

wherein the first stream is a cold stream arranged to have sufficient of the contaminants removed to meet a product specification for the composition of the LNG stream;

wherein the second stream contains natural gas and the contaminants;

and in a second stage liquefying the first stream for commercial supply.

The simplified process described hereinafter sacrifices energy efficiency for the sake of simplicity with the result that producing LNG on a small scale can be practical.

Another advantage of the simplified process described hereinafter is that a standard off-the-shelf industrial refrigeration system can be used rather than a cryogenic system using exotic refrigerants. These fractionation and separation systems are also simpler but are capable of achieving near 100% purity of the methane product if required.

Depending on the composition of the feed gas it may also be possible to greatly simplify the upstream pre-treatment of the gas for removal of sulfur (if any), CO2 and water. It is necessary to reduce CO2 to very low levels to avoid the risk of CO2 freezing at temperatures that may approach −250 F (−155 C). It is also necessary to reduce water vapor down to 0.1 PPMV to avoid hydrate formation. If sulfur compounds and CO2 are not excessive in the feed gas they can both be removed along with the water using a fixed bed adsorption system. This will greatly simplify the process by eliminating the need for an amine plant.

A major difference between the simplified process and the conventional process for LNG production is that the product is fractionated and stored at 100 PSIA (7 atmospheres). Because the double walled LNG storage tank is relatively small it is not expensive to design it for 7 atmospheres This has the effect of raising the storage temperature from −255 F to about −200 F (−160 C to −130 C) which significantly reduces the demand on heat exchange and refrigeration equipment.

A major characteristic of the simplified process described hereinafter is that it results in dividing the gas into two streams, one of them being the purified, liquefied LNG product and the other stream being a natural gas stream which contains the contaminants and the by-products of the LNG purification process which have been transferred from the LNG into the second stream. These components include N2, CO2, Ethane, Propane plus any other heavy components. Depending on the composition of the feed gas and the required specification of the LNG product the second stream containing the transferring components can be 75% or more of the feed stream.

The second stream includes the regeneration stream from the adsorption unit which contains the CO2, sulfur (if any) and water vapor, plus the light and heavy vapors from the separation and fractionation system.

An important consideration with the simplified LNG system is that there must be a destination for the relatively large second effluent stream. The ideal situation is for the LNG plant to be located adjacent to a natural gas pipeline carrying pipeline quality gas. The feed gas can be drawn from the pipeline along with contaminants such as CO2 and water and after processing the second stream can be returned to the pipeline along with the contaminants. The source of the contaminants is the pipeline so returning them to the pipeline does not create an off-spec condition. The need for an adjacent pipeline in this case eliminates the possibility of using the process for stranded gas wells, since the definition of a stranded gas well is that it is a considerable distance from a pipeline. But the plant can serve stranded consumers of natural gas such as villages or industrial users who are too far from the pipeline to justify a branch from the pipeline to serve their own needs. Delivery of gas in the form of LNG may serve their needs in this case.

The simplified process herein can also serve stranded gas wells if there is sufficient local use of fuel to consume the second stream. The LNG produced can then serve more distant users.

The simplified process described hereinafter can also be used for peak shaving, tapping into the pipeline during periods of low demand to store gas for the time when demand peaks.

BRIEF DESCRIPTION OF THE DRAWINGS

One embodiment of the invention will now be described in conjunction with the accompanying drawings in which:

FIG. 1 is a process diagram of one embodiment of a process according to the present invention.

DETAILED DESCRIPTION

The process as shown in FIG. 1 proceeds in two stages. The first stage 1 is the purification step where unwanted gases such as CO2, water vapour, sulphur compounds and gases lighter than or heavier than methane are excluded from the feed gas 1.

The Feed gas at stream 1 from the pipe line P is fed to a compressor 100 and then to a stream to an adsorption unit 101. Since the LNG process is cryogenic it is also necessary to exclude CO2 and water vapour from the gas in unit 101 to avoid freezing problems in the low temperature equipment. Water is discharged in stream 4. The feed gas at stream 5.

The first stage separates the feed gas into two streams 16 and 21.

The first stream 16 is a cold stream that has sufficient of the contaminants extracted to meet product specifications for composition of the LNG and the second stream 21 that contains a significant quantity of the original natural gas from the natural gas supply plus substantially all of the components rejected from the first stream.

The first stage includes exchanger 102, chiller 103, exchanger 104 and expansion valve 105 acting to cool the gas through streams 6, 7, 8 and 9 to a cold separator 106 which carries out an initial separation of the two streams to form gas streams 11, 12 and 13 which pass through the exchangers 102 and 104 to a compressor 112 which feeds into the second stream 21 for return to the pipe line P.

From the first cold separator 106, the liquid passes through an expansion valve 107 and is fed to the top of the fractionator 108 with reboiler 109. Liquid from the fractionator 108 in stream 17 passes through a sub-cooler 110 in stream 18 to recycle cold energy back into the process, then to an expansion valve and in stream 19 to a compressor 111 where it is fed in stream 20 into the second stream 21.

This simple separation process is inefficient in that the stream 21 contains a high proportion of the natural gas from the supply which can be in the range 50% to 80% depending on composition and standard of product purity and is preferably of the order of 70 to 75%. This level of natural gas cannot of course be discarded and hence must be re-used by return to the pipeline P or used in another process such as locally in supply to conventional natural gas supply systems.

Production of LNG is a cryogenic process which requires extremely low temperature. Temperature is an expression of the kinetic energy of the gas molecules, so to attain a reduction in temperature, energy must be removed from the gas. There is a chain of heat exchangers in the purification process whose purpose is to remove heat from the incoming feed gas; the compressor discharge cooler that removes a major portion of the heat energy by rejecting heat of compression, usually to the atmosphere using ambient air as coolant. The refrigerated chiller typically uses a propane vapour-liquid cycle which also rejects heat energy to the environment. The refrigerant sub-cooler recycles cold energy back into the process by sub-cooling the liquid refrigerant. The warm and cold flash drum heat exchangers transfer cold energy to the feed stream using cold feed flash drum vapour as coolant. This flash drum overhead vapour contains most of the contaminants lighter than methane and constitutes a major portion of the second stream.

Feed gas exiting the cold feed flash drum exchanger will typically be at 1500 PSI and at a temperature approaching minus 100° F. It then flows through an expansion valve which reduces its pressure to approximately 150 PSI and drops the temperature to near minus 200° F. The expansion is adiabatic, so enthalpy upstream of the valve is equal to the enthalpy downstream. The feed stream entering the valve is high pressure dense phase gas well above the critical pressure, but thermodynamic equilibrium downstream results in the condensation of a significant amount of hydrocarbon liquid at the lower pressure. The two phase stream enters the feed flash drum where gas plus light gases are separated overhead and the condensed liquids settle to the bottom of the vessel where they are removed through a level control valve which directs the cold liquid to the top of the gas fractionator.

When the phase change occurs from gas to liquid, molecular activity undergoes a step wise decrease in energy level which is called latent heat of condensation. Thus the liquid phase hydrocarbons exiting the feed flash drum are a store house of cold energy in very concentrated form. This liquid stream of cold energy flows into the top of the gas fractionator above the top stage. There is no need for a reflux condenser on the gas fractionator because the cold feed entering the column is typically below minus 200° F. which is sufficient to establish the necessary temperature gradient in the top of the column. The bottom of the column is typically a few degrees warmer than minus 200° F. with reboiler heat being supplied by a side stream of dehydrated warm feed gas. This recycles cold energy back into the process so nothing is lost.

The overhead stream from the gas fractionator is typically over 99%, methane that is less than 1% contaminants, while the bottom product which contains the heavier than methane contaminants is typically 40 to 70% methane, depending on product specifications, feed composition and operating conditions. The bottom product is a component part of the second stream that exits the process. The purified overhead stream which meets the specified product standards also carries with it its store of cold energy and is called the first steam which then proceeds to the second stage of the process where the product is liquefied.

The first stage of this process transfers cold energy to the first stream from the second stream. One of the major tasks of the first stage is to create cold energy which is conserved and transferred into the second stage of the process.

As set out above, the gas from the fractionator 108 forms the first stream 16 and is a relatively low proportion of the feed gas but contains low proportion of the contaminants so that it meets specification for LNG.

The first stream 16 is fed into streams 23, 24, 25 through exchangers 117 and 115 and to compressor 113 where streams 26, 27 flow to compressor 114 to generate a stream 29 which passes through exchanger 115, chiller 116 and exchanger 117 to stream 32 which is fed to expansion valve 118. Stream 33 from the valve 118 is fed to the cold separator 119 where liquid at stream 34 is fed to a storage tank 120. Vapors from the cold separation 119 at stream 35 and from the storage tank at stream 37 are fed back at stream 38 to the stream 23. Blow down from the stream 26 is fed back to the second stream 21.

The purified gas thus exits the equipment of the first stage at stream 16 and enters the second stage 2 whose purpose it is to liquefy the purified gas, which is principally methane, at stream 34 to store in tank 120. The second stage of the process in addition to liquification of the product also liquefies vapour which evolves at stream 37 from the contents of the LNG storage tank 120 due to influx of ambient heat from the surroundings. The recycled vapours 37 from the storage tank 120 may contain a small amount of light gas which preferentially vaporizes from the stored liquid which, where necessary, is returned at blow down stream 27 to the first stage of the process to be combined with other contaminants at stream 21 in the first stage. The accumulation of light gas due to recycling can in some cases interfere with the liquification process. A small continuous blow down 27 from the recycled gas stream prevents this.

To obtain essentially pure methane using the conventional cryogenic fraction process is difficult, requiring many distillation stages with high reflux ratio and high reboil heat to increase vapour/liquid traffic in the columns. Such a difficult separation process can be justified on a large scale, but for the LNG plant described herein a loss of separation efficiency and thus high level of methane in the discharge second stream can be tolerated for the sake of simplicity. The simplified process can provide a very high level of product purity in the first stream by eliminating unwanted components to whatever degree is required, but one drawback of using the simplified process is that while separating out the unwanted gases a significant portion of the methane product is also lost and ends up in the second stream exiting the process.

Product purification is carried out in the simplified process where the incoming feed gas is first compressed at compressor 101, pre-cooled at exchangers 102 and 104 and chiller 103, and expanded at valve 108 into either a low temperature separator or fractionator to separate out the light gases. A significant amount of methane is lost as it is carried overhead in stream 11 along with the light gases. The next step of the separation is to fractionate, in fractionator 108, the bottom liquid at stream 10 from the initial feed gas separation to eliminate components heavier than methane by cryogenic distillation, producing an overhead product at stream 16 that is almost pure methane. Again, in this case a significant portion of methane may be lost along with the heavier components exiting from the fractionator as a bottom product at stream 17.

Apart from light gases and light hydrocarbon liquids, another component that often must be removed is carbon dioxide. The reason is that at cryogenic temperatures CO2 condenses to a solid that can foul equipment and piping. If the CO2 in the feed gas is not excessive the simplest and most convenient way to remove the CO2 is to use an adsorption process with an adsorbent such as molecular sieve which picks up CO2 selectively without affecting the hydrocarbons. The absorbent bed 101 is regenerated using hot natural gas which strips the CO2 from the bed. The regeneration gas at stream 3 which contains the CO2 is then part of the second stream 22 leaving the plant.

Water vapour is another contaminant that is removed from the feed gas to extremely low levels to avoid formation of gas hydrates in the cryogenic section of the plant. Gas hydrates are loose chemical compounds that form at high pressure between water molecules and hydrocarbon molecules, in this case principally methane. Hydrates are solids that can plug equipment and piping, and the best way to prevent them is to remove the water from the gas. Fixed bed absorption using a desiccant such as a molecular sieve is the usual way of removing water down to parts per million level. The regeneration gas in stream 3 which contains the water vapour is combined with the contaminants in the second stream 22 leaving the plant. If an adsorption process is being used to remove CO2, the same process can be used to remove water, using an absorbent that co-adsorbs both CO2 and water.

The second stream 22 leaving the process is set up to be the carrier of gases rejected from the feed stream 1. However there is a second reason why a second stream 22 is necessary. A relatively large feed stream must be used to create the necessary cold energy to separate and purify the product gas. This cold energy which is created by the large volumes of feed gas is concentrated in the first stage 1 of the process and transferred in the cold stream 16 into the second stage where it is used to liquefy the methane product. The feed gas 1 enters the process warm and the second stream 22 leaves the process warm but the product stream 16 flowing into the liquification phase 2 of the process is extremely cold. The second stream 22 is needed so that the surplus gas in the feed stream 1 is enough to create the necessary cold.

Feed gas enters stage 1 of the process where it is chilled to cryogenic temperature at stream 9 prior to the initial separation, either by gravitational separation or fractionation at separator 106. The chilling is by heat exchange, refrigeration, compression and Clausius Clapeyron expansions at valve 105. This initial separation is to remove most of the gases lighter than methane. The process of removing light gases unavoidably results in the loss of a significant amount of methane which is carried over with the light gases. The bottom liquid from the initial separation at stream 10 is expanded through the let down valve 107 into the top of the distillation column 108 whose purpose is to eliminate components heavier than methane from the product. The overhead gas from the fractionator is essentially pure methane at extremely low temperature. The bottom product which contains components heavier than methane also contains a significant amount of methane. The bottom product, which is extremely cold, flows to a heat exchanger Called a sub cooler to recycle cold energy back into the process via the refrigerant, then becomes part of the second stream leaving the process.

The overhead product leaving the fractionators in the vapor state meets the necessary specifications for product purity, so the remaining task is to liquefy the product so it can be marketed as LNG. The purification process, generates low temperatures which have been conserved and recovered and concentrated in the product stream entering stage 2, the liquification process. The recovered cold energy leaves stage 1 as fractionator overhead vapour and it is the low temperature energy contained in this stream plus refrigeration and Clausius Clapeyron expansions that are principally used to liquefy the product. The large feed stream required by the process is necessitated in part by the cold energy required by the liquification process.

The Fractionator 108 overhead vapour enters stage 2 in stream 16 as a very cold vapour. To liquefy the product it is necessary to remove the latent heat of vaporization to convert the gas into a liquid. The chilling circuit consists of compressors 113, 114 to raise the gas pressure, heat exchangers and refrigeration to pre-cool the compressed gas, Clausius Clapeyron expansion valve 118 to auto refrigerate the cold high pressure stream into a cold separator operating at near product storage temperature. The compressing, chilling, and expansion acts to liquefy about half of the separator feed. From the cold separator 119 the cold liquid then flows into storage. The cold gas from the separator 119 is then combined with the stage 1 fractionator 108 overhead vapour which is then used by the heat exchangers 115, 117 to pre-cool high pressure vapour up stream of the expansion valve 118. The combined separator vapour at stream 38 and fractionator overhead stream 16, after recycling its cold energy back into the process, flows to the suction of the multi-stage compressor 113, 114 to compress the gas prior to chilling and expansion. Propane refrigeration may be necessary to attain the required degree of chilling. The recycle rate of the liquification system equilibrates at a flow sufficient to produce liquid at a rate equal to the rate of overhead vapour entering stage 2 at stream 16. Evolved vapours from storage also add to the recycle rate and add additional liquid to be condensed in the cold separator 119. Non-condensable gases, if any, concentrate in the separator vapour and it may be necessary to have a continuous small blow down 37 to stage 1 of the process to prevent accumulation of non-condensable gases in the recycle circuit.

Shipping of LNG by its nature is not a steady, continuous operation. Whether transport by ship, barge, railcar, or truck there are unavoidable surges and interruptions in the flow while loading arms are connected or disconnected. It is desirable to keep a steady flow to avoid upsetting the process equipment but it is not a practical to make the loading process a completely steady operation. Therefore on-site storage is necessary to act as a buffer to accommodate minor surges in flow while loading. If LNG is to be shipped to market be sea or by land transport it is desirable to have at least two transport vehicles connected at the loading arms so that the flow is as continuous as possible. When one transport vehicle is filled, the loading is transferred immediately without interruption to the second vehicle which has been connected up and waiting, ready to receive its cargo. Meanwhile the first fully loaded vehicle departs from the loading area and another empty vehicle takes its place to be connected to the loading arm. This is the most desirable mode of operation because it minimizes the need for large volume buffer storage on site. LNG storage is expensive, so minimizing the size of the tank is good economics, but the size of the tank must be integrated with the plan for shipping. If the LNG process is to be used for peak shaving a large tank is required and special consideration must be given to the design pressure of the tank and the recycling of tank vapours back to the liquification system. LNG must be stored in a double walled insulated tank to minimize vaporization losses. If the tank is small, it is proposed to store the liquid at 100 PSIA (700 KPaA). This simplifies the process and permits storage at a temperature about 50° F. (28° C.) warmer than in an atmospheric tank as is done in the conventional LNG process. To store at atmospheric pressure requires additional stages of vapour compression and an increase in recycle volume. If storage is at 100 PSIA there is a lower volume of tank vapour due to influx of ambient heat resulting in a reduced compressor load.

The LNG facility is the preferred distribution station for various users of the LNG product, but there is a possible option to the process that enables loading of the CNG (compressed natural gas) into a vehicle such as a truck equipped with a high pressure CNG trailer. CNG is normally transported at 3000 PSI (20700 KPa) by truck to distribution centers such as natural gas filling stations or to single user such as brick plants or cement factories.

The LNG is drawn from the LNG storage tank and into a cryogenic pump as a liquid then through a back pressure valve then flashed into a vaporizer, then into the tanks of the CNG trailer in the gaseous state at approximately ambient temperature. Filling continues until the tanks were full at 3000 PSI. The cold energy recovered from the vaporization process can be recycled back into the LNG process.

The invention claimed is:

1. A method for production of liquefied natural gas (LNG) comprising:

taking a supply stream of natural gas including contaminants including water vapor, CO2 and H2S, and by-products including light overhead gases and heavier hydrocarbons including Ethane, Propane and any other heavy components;

in a compression step, compressing said supply gas stream;

in an extracting step, extracting from the supply gas stream said water vapor, H2S and CO2 of said contaminants;

in a cooling step, cooling the entire supply gas stream excluding the contaminants extracted in said extracting step and forming a dense phase stream which is arranged to produce a two phase liquid/vapor stream on subsequent expansion;

downstream of the compressing, extracting and cooling steps in an expanding step expanding the entire compressed, cooled, dense phase, supply gas stream to form an expanded stream which is a two phase liquid/vapor stream;

at a first separation step subsequent to the expanding step, separating the expanded stream into a first stream and a second stream;

wherein the first stream contains Ethane, Propane and heavy components together with some methane;

wherein the second stream contains some methane and most of said light overhead gases;

further expanding the first stream and supplying the further expanded first stream to a second separation step comprising a fractionator or separator;

in the fractionator or separator in the second separation step, separating the first stream into an overhead vapor stream and a bottom stream;

wherein the bottom stream contains some methane and most of the said Ethane, Propane and any other heavy components;

wherein the overhead vapor stream is a cold energy supply gas stream consisting mainly of methane arranged to be sufficiently pure by having sufficient of the H2O, CO2 and H2S contaminants, and light overhead gases and heavier hydrocarbons, removed to meet a product specification for the composition of an LNG supply;

providing a commercial supply as LNG from the overhead vapor stream;

said bottom stream being removed for use separate from said commercial supply;

wherein the second stream is not supplied to the fractionator or separator in said second separation step but is instead used as a coolant in upstream heat exchangers acting on said supply gas stream after said extracting step and is removed for use separate from said commercial supply.

2. The method according to claim 1 wherein said bottom stream from the fractionator or separator is used in gaseous form as a natural gas supply.

3. The method according to claim 1 wherein said bottom stream from the fractionator or separator is used in liquid form as a low grade LNG.

4. The method according to claim 1 wherein said bottom stream and said second stream are discarded to a common discharge stream for said separate use.

5. The method according to claim 4 wherein said discharge stream is used in said separate use in gaseous form as a natural gas supply containing said heavier hydrocarbons and of lower quality than said commercial supply of LNG.

6. The method according to claim 1 wherein the LNG is supplied in a container maintained under a pressure greater than one atmosphere.

7. The method according to claim 1 wherein the overhead stream from the second separation contains less than 1% of contaminants.

8. The method according to claim 1 wherein the second stream from the first separation together with the bottom stream from the second separation comprises in the range 70 to 75% of the supply stream.

9. The method according to claim 1 wherein the overhead stream from the second separation comprises in the range 25 to 30% of the supply stream.

10. The method according to claim 1 wherein the supply stream is taken from a natural gas pipeline and the second stream and the bottom stream are returned to the pipeline.

11. The method according to claim 1 wherein the supply stream is a stranded gas well and the second stream from the first separation and the bottom stream from the second separation are consumed locally as a natural gas supply.

12. The method according to claim 1 wherein the supply stream is from a pipe line and the method is used for peak shaving by tapping into the pipe line during periods of low demand to store gas for use in periods of high demand.

13. The method according to claim 1 including extracting cool from the bottom stream from the second separation to act as a source of cooling recycling cold energy back into the supply stream.

* * * * *